United States Patent [19]

Ittner et al.

[11] 4,023,692

[45] May 17, 1977

[54] APPARATUS FOR OPENING AND UNLOADING CARTONS

[75] Inventors: Delbert J. Ittner, Saginaw; Robert W. Hofstetter, Fenton, both of Mich.

[73] Assignee: I & H Conveying and Machine Company, Clio, Mich.

[22] Filed: Dec. 15, 1975

[21] Appl. No.: 640,752

Related U.S. Application Data

[63] Continuation-in-part of Ser. No. 490,681, July 22, 1974, Pat. No. 3,937,342.

[52] U.S. Cl. ..... 214/304; 30/2

[51] Int. Cl.² ..... B65G 65/42

[58] Field of Search ..... 214/304, 305; 30/2; 198/102; 222/80, 81, 83

[56] References Cited

UNITED STATES PATENTS

| | | | |
|---|---|---|---|
| 2,648,450 | 8/1953 | Neal | 214/304 |
| 2,925,185 | 2/1960 | Candido, Jr. | 214/304 |
| 2,935,215 | 5/1960 | Rose | 214/304 |

*Primary Examiner*—Robert J. Spar
*Assistant Examiner*—Lawrence J. Oresky
*Attorney, Agent, or Firm*—Gifford, Chandler Sheridan & Sprinkle

[57] ABSTRACT

An apparatus for automatically opening and emptying a carton for reuse by folding the outer flaps of the carton away from the opening into the carton as the carton moves linearly in a first direction, folding the inner flaps of the carton away from the opening in the carton as the carton moves linearly in a second direction and separating the carton from the contents while the contents continue to move in a second direction. Upon separation, the carton is automatically transported to a remote location for reuse.

13 Claims, 4 Drawing Figures

98
76
77
74
66
75
32
64
68
70
72
126
34
78
41
38
112
114
120
39
26

98
16
18
12
"H"
"B"
30
74
64
68
34
78
"A"
"D"
"E"
22
28
50
52
54
56
120

APPARATUS FOR OPENING AND UNLOADING CARTONS

CROSS REFERENCE TO RELATED APPLICATIONS

The present invention is a continuation-in-part of patent application Ser. No. 490,681, filed July 22, 1974 and now U.S. Pat. No. 3,937,342 issued on Feb. 10, 1976.

BACKGROUND OF THE INVENTION

I. Field of the Invention

The present invention relates to material or article handling devices, and more particularly to such devices which provide for engaging and emptying cartons and having means for opening the carton prior to the emptying operation.

II. Description of the Prior Art

There are a number of prior art devices for opening a carton and emptying its contents while conveying it from one location to another.

Heretofore known devices of this type have had one or more of the following characteristics: destruction of the carton; rough handling of the contents of the carton upon separation or removal of the contents from the carton; lack of adjustability of the means for moving the carton, thereby limiting its application; large physical size, thereby taking up valuable floor space; a requirement for accurate synchronization of the movement of various components; and high cost of manufacture and maintenance because of the use of a complicated structure and use of complicated parts.

My prior carton opener and unloader, disclosed in U.S. Pat. No. 3,937,342, issued on Feb. 10, 1976 solved many of these disadvantages of the previously known carton openers and unloaders. However, several problems were encountered with my prior device when cartons containing relatively small items were opened and unloaded. Most notably, the contents of the carton have a tendency to fall from the carton during the flap unfolding processing steps, and particularly during the step of unfolding the outer carton flaps when the inner flaps do not substantially cover the contents of the carton.

SUMMARY OF THE INVENTION

The present invention provides an apparatus for opening a carton and separating it from its contents, such as empty jars, in such a way that the carton can be reused when the empty jars have been filled. The apparatus includes a first conveyor portion for moving the cartons to be opened in a first direction through and past carton outer flap folding bars which fold the outer flaps away from the opening in the carton and hold them in this position. A second conveyor portion is provided which moves the partially opened cartons in a second direction substantially perpendicular to the first direction, past and through carton inner flap folding and engaging means which fold the inner flaps away from the opening in the carton. A transfer station moves the cartons with their outer flaps folded away from the opening in the cartons to the second conveyor. After the cartons are opened, the cartons are directed to a third conveyor portion which removes them from the second conveyor portion, leaving the contents on the second conveyor portion to be transported to subsequent work stations, and to transport the now empty carton to a remote location to await reuse.

The first, second and third conveyor portions are independently adjustable so that the apparatus is adaptable for opening and emptying cartons of various sizes.

In order to prevent the contents of the carton from dropping from the carton during the outer flap unfolding operation, a supporting plate is provided between the outer flaps and the carton so that the contents of the carton are supported by the plate in addition to the carton inner flaps. Similarly a laterally wide supportive surface is provided underneath the carton during the inner flap unfolding operation for the same purpose.

DESCRIPTION OF THE DRAWINGS

The preferred embodiment of the present invention is illustrated in the accompanying drawings wherein like numerals refer to like parts throughout the several views, and in which.

DESCRIPTION OF THE PREFERRED EMBODIMENT

Figures 1, 4:
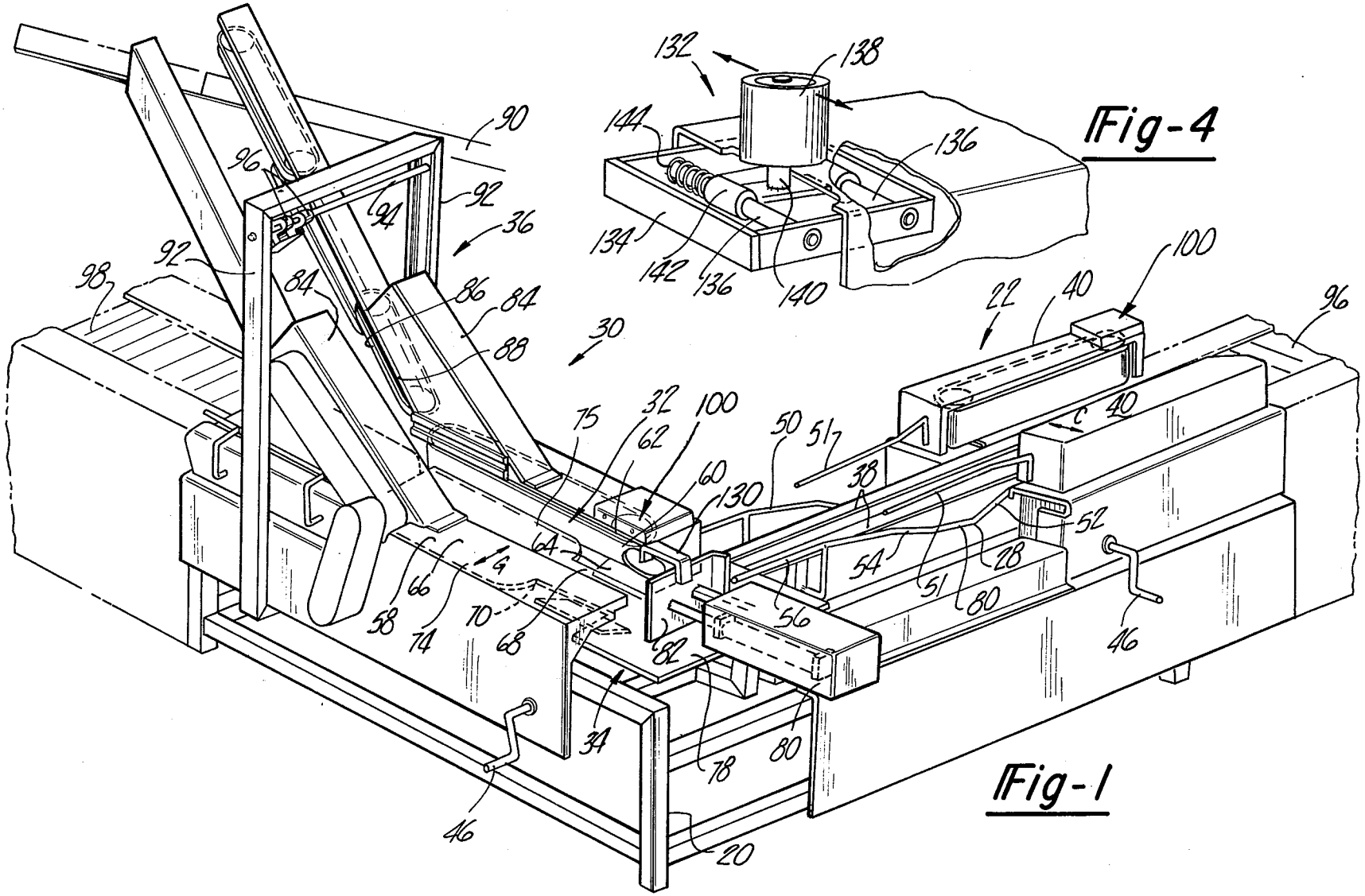
FIG. 1 is a perspective view of the apparatus of the present invention for opening and unloading cartons.
FIG. 4 is a perspective view with parts removed showing the centering means for the second conveyor of the present invention.

The drawings illustrate an apparatus 10 for opening and unloading cartons 12 (FIG. 3) filled with articles 14, such as glass jars. The cartons 12 are, for example, cardboard cartons having inner flaps 16 which are connected to and folded from opposite edges of the carton over the opening in the carton, and outer flaps 18 which are connected to and folded from different opposite edges of the carton over the folded inner flaps, thus closing the carton 12. The present invention has shown particular utility for use with a carton 12 where the inner flaps 16 do not substantially cover the contents 14 of the carton 12 and where the articles 14 are of relatively small size.

The overall object of the apparatus 10 is to rapidly and automatically open a succession of cartons 12 by folding the outer flaps 18 and the inner flaps 16 away from the opening in the carton 12, unloading the articles 14 therefrom and separately transporting the articles 14 and empty cartons 12 to different locations, all this without destroying the cartons 12 so that they can be reused.

Referring again to the drawings, the carton opening and unloading apparatus 10 is generally comprised of four work stations which are supported on a frame 20 (FIG. 1).

Figure 2:
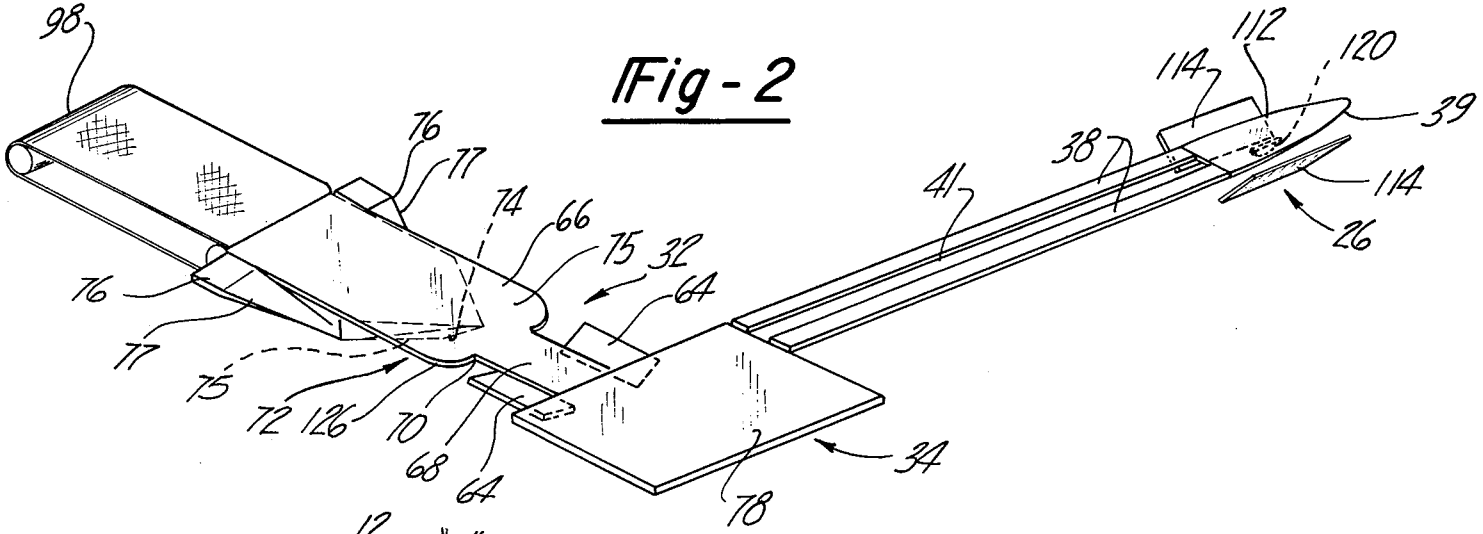
FIG. 2 is a perspective view of the those carton opening and conveying components hidden from view in FIG. 1.
Figure 3:
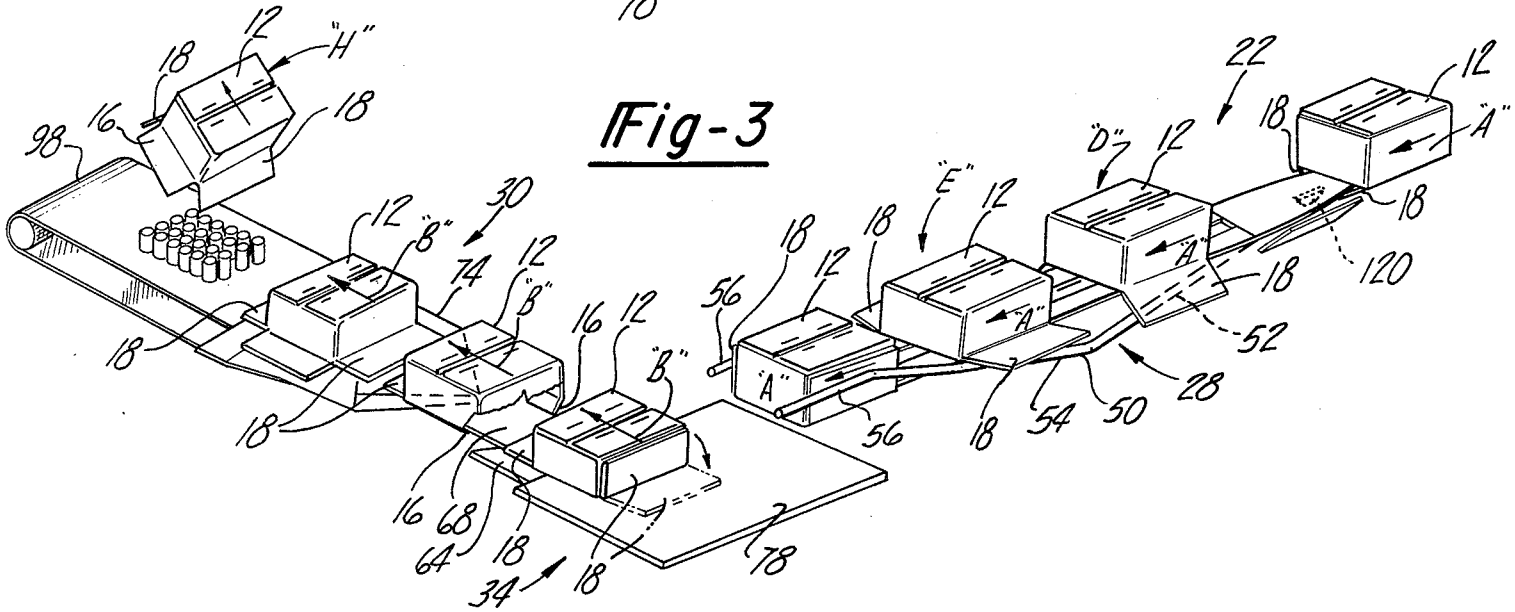
FIG. 3 is a perspective view similar to FIG. 2 illustrating cartons progressing through the apparatus.

As can best be seen in FIGS. 1 and 3, the function of the first work station is to fold the outer flaps 18 away from the opening in the carton 12 and the transport the cartons 12 to the second work station. The first work station comprises a first conveyor means 22 for moving the cartons 12 in a first direction (indicated by the flow arrows "A" in FIG. 3), carton outer flap engaging means 26 (FIGS. 2 and 3), and carton outer flaps folding means 28 (FIG. 2).

The function of the second work station is to fold the inner flaps 16 away from the opening in the carton 12 and to transport the cartons 12 through the second station to a discharge location. The second work station, as can best be seen in FIGS. 1 and 3, comprises a second conveyor means 30 for moving the cartons 12 in a second direction (indicated by flow arrows "B" in FIG. 3) substantially 90° to the first direction A, and carton inner flap engaging and folding means 32 (FIGS. 1 and 2).

The function of the third work station is to move the cartons 12 from the first work station to the second work station and, as can best be seen in FIGS. 1 and 2, comprises a transfer means 34 disposed between the exit from the first work station and the entrance to the second work station.

The function of the fourth work station is to empty the articles 14 from the carton 12 by separating the carton 12 from the second work station without disturbing the articles 14, and, as illustrated in FIG. 1, comprises a third conveyor means 36 which engages the cartons and separates them from the articles 14.

Referring again to FIGS. 1 and 2, the first conveyor means 22 comprises a pair of spaced apart elongated tracks 38 with a supporting surface 41 between the tracks 38 extending in the first direction A for supporting the cartons 12 as they move, and a pair of spaced apart first drive means, such as first endless belt conveyors 40 (FIG. 1), disposed on opposite sides of the tracks 38. The outer surface 42 of the belt 44 of each conveyor 40 is oriented in a vertical plane parallel to the first direction A. The cartons 12 are received between the conveyors 40 and are frictionally engaged on opposite sides by the outer surfaces 42 of the respective belts 44 and are thereby moved in the first direction A. It is apparent that as one carton 12 is engaged and moved by the belt conveyors 40 it engages the carton 12 ahead of it and moves it in the direction A. The cartons 12 are shown in spaced position in FIG. 3 to more clearly indicate the operation of the flap opening means.

One of the belt conveyors 40 is mounted on the frame 20 for selected movement in a direction (indicated by arrow "C" in FIG. 1) transverse to the first direction A. Thus, the space between the conveyors 40 can be selectively changed to engage cartons 12 of different sizes. The movable mounting of the conveyor 40 to the frame 20 is accomplished by, for example, transverse adjusting means 100, best shown in FIG. 4.

One of the belt conveyors 40 is mounted on the frame 20 for selected movement in a direction (indicated by arrow C in FIG. 1) transverse to the first direction A. Thus, the space between the conveyors 40 can be selectively changed to engage cartons 12 of different sizes. The movable mounting of the conveyor 40 to the frame 20 is accomplished by, for example, a crank 46 journaled in the frame 20 and having a threaded shank which engages a correspondingly threaded bore in a pillow block (not shown) attached to the belt conveyor. As the crank 46 is turned, the block is caused to travel in the direction of the threaded shank of the crank 46 by the interaction of the threaded shank and threaded bore, thus moving the conveyor 40 in the direction of the shank to expand or contract the space between the pair of conveyors 40. In addition, a tension mechanism 100 is provided on each conveyor to adjust the tension of the conveyor belts.

As best seen in FIGS. 2 and 3, the carton outer flap engaging means 26 comprises a tapered end 39 on the end of a supporting plate 112 facing against the first direction A of the moving cartons. The tapered end 39 is received between a different outer flap 18 and the carton 12 to separate the outer flaps 18 therefrom (FIG. 3) as the cartons 12 are moved by the conveyor 40 for subsequent contact with the outer flap folding means 28 (FIG. 3).

Still referring to FIGS. 2 and 3, a pair of sloping plates 114 are provided adjacent the tapered end 39 of the supporting plate 112. Thus as the outer flaps 18 fall downwardly to the plates 114, the supporting plate 112 abuts against and supports not only the inner flaps 16 of the carton, but also the articles 14 in the carton. A small V-shaped member 120 is disposed beneath the plate 112 to ensure the opening of the outer flaps 18.

As can best be seen in FIGS. 1 and 3, the outer flap folding means 28 further includes a pair of spaced apart bars 50 disposed on opposite sides of the pair of elongated tracks 38. Each bar 50 comprises a first elongated portion 52 extending outwardly and downwardly from a different one of the tracks 38 in the general direction A of the moving cartons 12, and terminating at a location outwardly and below the tracks 38; a second elongated portion 54 extending inwardly and upwardly, with respect to its adjacent track 38, from the outermost extension of the first portions 52 in the general direction A of the moving cartons 12, and terminating at a location above and spaced outwardly from its adjacent track 38 and a third portion 56 extending from the uppermost extension of the second portion 54 parallel to and spaced from its adjacent track 38. The space between the third portions 56 of the pair of bars 50 is generally the width of the carton 12 plus the thickness of the outer flaps 18. The bar 50 is preferably integrally formed of the three portions 52, 54, and 56.

As the cartons move in the first direction A the outer flaps 18 separated by the V-shaped member 120 contact the pair of folding bars 50, each one of the pair of bars contacting a different outer flap 18. The first portion 52 pivots the outer flaps 18 generally downwardly away from the opening in the carton 12, as indicated at "D" in FIG. 3. Upon contact with the second portion 54, the outer flaps 18 are pivoted generally upwardly, as indicated at "E" in FIG. 3, toward a location where they are substantially parallel to and overlay the adjacent carton sidewall. The third portion 56 cages the outer flaps 18 in their overlaying relationship to the carton sidewalls, as indicated at "F" in FIG. 3. The reason for folding the outer flaps 18 to this overlaying position will become clear as the transfer means 34 is described more fully.

As can be seen in FIG. 1, a pair of spaced apart guide bars 51 are provided on opposite longitudinal sides of the pair of tracks 38 between the conveyor 40 and the third portions 56 of the outer flap folding bars 50 to guide the cartons 12 as they move in the direction therebetween.

As can best be seen in FIG. 1, the second conveyor means 30 is similar to the first conveyor means 22, and comprises a pair of spaced apart second drive means, such as endless belt conveyors 58, disposed on opposite longitudinal sides of the carton inner flap engaging and folding means 32. The outer surface 60 of the belt 62 of each conveyor 58 is oriented in a vertical plane parallel to the second direction B. The cartons 12 are received between the conveyors 58 and are frictionally engaged on opposite sides by the belts 62 and are thereby moved in the second direction B. Both of the belt conveyors 58 are mounted on the frame 20 for selected movement in a lateral direction (indicated by the arrow "G" in FIG. 1) transverse to the second direction B by adjusting means 126 which are substantially indentical to adjusting assembly 100. Thus, the space between the pair of belt conveyors 58 can be selectively changed to engage cartons of different sizes. The movable mounting of the conveyor 58 is accomplished in the same manner as that of the movable conveyor 40.

Now referring to FIGS. 1, 2, and 3, the carton inner flap engaging and folding means 32 comprises a pair of parallel spaced apart support plates 64 sloping downwardly and inwardly from opposite longitudinal sides of the engaging and folding means, a horizontal elongated plate 66 (FIG. 2) disposed downstream in the direction B from the sloping plates 64 and an article support member 68 extending horizontally from the leading edge 70 of the plate 66 between the sloping plates 64. The article support member 68 is sufficiently wide to support all of the articles 14 in the carton 12.

As can best be seen in FIG. 2, the leading corners 72 of the elongated plate 66 are tapered at 126 and a generally V-shaped inner flap folding plate 74 is disposed beneath the horizontal elongated plate 66 with its apex facing upstream or against the second direction B of movement of the cartons 12. Each of the sloping edges 75 of the V-shaped plate extend outwardly toward a different longitudinal edge of the elongated plate 66 in the direction B of movement of the cartons. A pair of horizontally positioned inner flap folding plate extension members 76 are located along opposite longitudinal sides of the elongated plate 66. Each extension member 76 is generally triangular in shape having its outer edge 77 extending angularly outwardly from the adjacent longitudinal edge of the elongated plate 66, generally in the second direction B of movement of the cartons.

Still referring to FIGS. 2 and 3, as the cartons pass over the article support member 68 and the sloping support plates 64, the inner flaps 16 pivot downwardly away from the opening in the carton 12 under the influence of the weight of the articles 14 until they contact the sloping support plates 64, thus positioning the inner flaps 16 for contact with the corners 74 of the elongated plate 66. The support member 68 prevents the articles 14 from coming out of the carton 12 and supports the carton 12 as it moves in the second direction B. As the carton 12 continues to move from the sloping support plates 64, the carton 12 is received on the top surface of the elongated horizontal plate 66 and the inner flaps 16 are engaged by the tapered corners 126 which cause the inner flaps 16 to pivot downwardly away from the opening in the carton 12. As the carton moves along the top surface of the horizontal plate 66, the inner flaps 16 engage the sloping edges 75 of the V-shaped plate 74 and are caused thereby to continue to pivot downwardly. The inner flaps 16 next contact the extension members 76, and as the carton continues to move in the second direction B, the inner flaps 16 move along the outwardly extending edges 77 of the extension member 76 and are thus pivoted upwardly to be in a horizontal plane.

As hereinabove mentioned, the first conveyor means 22 is disposed at an angle 90° to the second conveyor means 30. The transfer means 34 receives the cartons 12 from the first conveyor means 22 and redirects them into the second conveyor means 30. As can best be seen in FIG. 1, the transfer means 34 comprises a horizontally disposed plate 78 which supports the carton 12, a transfer mechanism such as a fluid operated cylinder 80 disposed with its axis of movement in the direction B of movement of the cartons 12, and a carton engaging member such as a vertically disposed plate 82 connected to the piston rod of the cylinder 80. Preferably a member 130 is secured to the plate 82 and extends over the plate 78. The member 130 is adapted to receive the cartons 12 therebelow and to prevent the cartons 12 from bouncing upward upon actuation of the cylinder 80. Cartons 12, having their outer flaps 18 olded away from the opening in the cartons 12, are received on the top surface of the plate 78. The position of the outer flaps 18 overlaying the carton sidewalls assures that they will not interfere with the plate 78 as they are moved onto the top surface of the plate from the tracks 38. Once the carton is on the plate 78, the outer flaps are allowed to fold downwardly to lay upon the top surface thereto. The fluid operated cylinder is activated by, for example, a switch (not shown) which is tripped by a carton on the plate 78 causing the piston rod to extend to place the carton engaging plate 82 in contact with the carton 12, and to push it in the second direction B into engagement with the second conveyors 58.

Referring to FIGS. 1 and 4, in order to properly center the cartons 12 between the conveyors 58, each of the conveyors includes a centering means 132, one of which is shown in FIG. 4. The centering means 132 comprises a housing 134 having two spaced and parallel rods 136 disposed thereacross and generally perpendicular to the direction of travel of the conveyors 58. A conveyor roller 138 is rotatably mounted on an axle 140 which in turn is slidably mounted on the rods 136 by a bracket 142. A helical spring 144 is disposed around each rod 136 between the housing 134 and the bracket 142 so that the springs 144 urge the conveyors 58 toward one another. Since the centering means 132 are substantially the same for both of the conveyors 50, the means 132 function to automatically center the cartons 12 onto the plate 66.

Still referring to FIG. 1, the third conveyor means 36 comprises a pair of spaced apart parallel endless third belt conveyors 84 disposed toward opposite longitudinal sides of the elongated plate 66. The conveyors 84 are inclined upwardly in the second direction B of the moving cartons from a location over the second conveyor means downstream in the second direction B from the location of the extension members 76. The outer surface 86 of the belt 88 of each conveyor 84 is oriented in a vertical plane parallel to the second direction B of movement of the cartons. The cartons 12 are received between the conveyors 84 and are frictionally engaged on opposite sides by the inwardly facing outer surfaces 86 of the respective belts 88 and are thereby lifted from the elongated plate 66, as indicated at "H" in FIG. 3. In being lifted from the plate 66 by the pair of third conveyors 84, the carton is gently separated from its article 14 onto a conventional belt conveyor 98.

The conveyors 84 are supported over the frame 20 by an overhead structure 90 which has two depending legs 92 connected at their bottom ends to the frame 20. One of the pair of conveyors 84 is connected at its lower end to the movably mounted one of the second conveyors 58 and movably mounted, between its ends, to a horizontal bar 94 connected at its opposite ends to the legs 92 and disposed transversely to the second direction B of the moving cartons by means of bearings 96 for movement in the axial direction of the bar 94. This mounting provides for adjustment of the space between the pair of third conveyors 84. As the space between the pair of second conveyors 58 is changed by manipulating the adjusting means 116 associated therewith, the space between the pair of third conveyors 84 is changed a corresponding amount.

A standard belt conveyor 96 may be located at the entrance to the first work station to deliver cartons to be opened to the apparatus 10. The articles 14 are taken by the conveyor 98 to a point of use. In the embodiment shown, the articles 14 are empty jars which can be filled and then taken to a point where they are repacked into the cartons 12 for shipment.

The foregoing detailed description is given primarily for clearness of understanding and no unnecessary limitations should be understood therefrom for some modifications will be obvious to those skilled in the art upon reading this disclosure.

We claim:

1. An apparatus for opening the flaps of a carton filled with articles and for unloading the articles from the cartons comprising:

first conveyor means for moving the cartons in a first direction;

carton outer flap folding means associated with said first conveyor means for folding the outer flaps of the carton from a closed position over the opening to the carton to a folded position away from their closed position as the cartons move in said first direction;

second conveyor means for moving the cartons in a second direction disposed at a predetermined angle to said first conveyor means;

carton inner flap engaging and folding means associated with said second conveyor means for folding the inner flaps of the carton from a closed position over the opening in the carton to a folded position as the cartons move in said second direction;

transfer means disposed between said first conveyor means and said second conveyor means for transferring said cartons from said first conveyor means to said second conveyor means; and third conveyor means disposed adjacent the end of said second conveyor means and extending upwardly away therefrom whereby to remove the cartons from said second conveyor means, the articles remaining on said second conveyor means; and said first conveyor means comprising a pair of parallel spaced apart elongated tracks longitudinally disposed in said first direction of travel to support the cartons as they move in said first direction; a pair of spaced apart first drive means disposed on opposite sides of said pair of tracks for engaging the opposite longitudinal sides of the cartons and moving them in said first direction; said carton outer flap engaging means comprising a support plate having a tapered end aligned with said elongated tracks and facing against said first direction of movement of said carton to be received between the carton outer flaps and the carton, said support plate having downwardly extending means fixed to the bottom of said support plate for initiating the opening of said outer flaps and being adapted to engage the inner flaps of the carton to prevent them from folding partially open due to the weight of the articles in the carton; and a pair of spaced apart outer flap folding bars, said bars being disposed on opposite sides of said pair of elongated tracks to engage said outer flaps and fold them as the carton moves in said first direction.

2. An apparatus as defined in claim 1, wherein each of said pair of spaced apart first drive means comprises a first endless belt conveyor having the outer surface of the belt which contacts the cartons disposed in a substantially vertical plane parallel to said first direction.

3. An apparatus as defined in claim 1, wherein each of said flap folding bars comprises a first portion extending generally outwardly and downwardly from one of said pair of elongated tracks in said first direction; a second portion extending generally inwardly and upwardly from the outermost extension of said first portion in said first direction to a predetermined location above and spaced outwardly from said one elongated track; and a third portion extending from the uppermost extension of said second portion in said first direction parallel to and spaced outwardly and upwardly a predetermined distance from said one elongated track, whereby as the carton moves in said first direction each of said outer flaps first contact said first portion of said respective flap folding bar which causes the outer flaps to fold first downwardly and then outwardly with respect to the carton as the carton moves in said first direction, upon engagement with said second portion the outer flaps are caused to fold upwardly toward their respective carton sidewalls, and upon engagement with said third portion the outer flaps are caused to lay in substantial juxtaposition to their respective carton sidewalls.

4. An apparatus as defined in claim 1, wherein at least one of said pair of spaced apart first drive means includes first transverse movement means for selected movement in a direction transverse to said first direction to provide adjustment of the space between said pair of first drive means for cartons of different sizes; and at least one of said pair of spaced apart second drive means includes second transverse movement means for selected movement in a direction transverse to said second direction to provide adjustment of the space between said pair of second drive means for cartons of different sizes.

5. An apparatus as defined in claim 1 and including means for centering said cartons between said second conveyor means.

6. An apparatus as defined in claim 5 wherein said second conveyor means comprises a pair of spaced apart drive means with an endless belt associated with each drive means and adapted to engage the side of said cartons and wherein said means for centering said cartons comprises a spring means associated with each of said drive means and adapted for urging said drive means toward each other.

7. An apparatus for opening the flaps of a carton filled with articles and for unloading the articles from the cartons comprising:

first conveyor means for moving the cartons in a first direction;

carton outer flap folding means associated with said first conveyor means for folding the outer flaps of the carton from a closed position over the opening to the carton to a folded position away from their closed position as the cartons move in said first direction;

second conveyor means for moving the cartons in a second direction disposed at a predetermined angle to said first conveyor means;

carton inner flap engaging and folding means associated with said second conveyor means for folding the inner flaps of the carton from a closed position over the opening to the carton to a folded position as the cartons move in said second direction;

transfer means disposed between said first conveyor means and said second conveyor means for transferring said cartons from said first conveyor means to said second conveyor means;

third conveyor means disposed adjacent the end of said second conveyor means and extending upwardly away therefrom whereby to remove the cartons from said second conveyor, the articles remaining on said second conveyor means; and said second conveyor means comprises a pair of spaced apart second drive means disposed on opposite sides of said carton inner flap engaging and folding means to move the cartons in said second direction; said outer flap engaging and folding means comprising a pair of paarallel spaced apart downwardly and inwardly inclined support plates which permit the outer flaps to partially open a predetermined amount by folding downwardly under the influence of the weight of the articles in the carton; an elongated horizontal support plate extending means fixed to the bottom of said horizontal support plate for initiating the opening of said outer flaps and having its leading end tapered to engage the outer flaps as the carton moves from said support plates onto said horizontal support plate and to support the articles in the carton as the carton moves in said first direction; and a generally V-shaped outer flap folding plate disposed beneath said horizontal support plate having its apex facing against said second direction of movement and having its sloping edges extending toward opposite longitudinal sides of said horizontal support plate.

8. An apparatus as defined in claim 7, wherein each of said pair of second drive means comprises a second endless belt conveyor having the outer surface of the belt which contacts the cartons disposed in a substantially vertical plane parallel to said second direction.

9. An apparatus as defined in claim 7, further comprising a pair of horizontally disposed inner flap folding plate extension members disposed along opposite longitudinal sides of said horizontal plate, each of said extension members having an outer edge which slopes outwardly from a different longitudinal edge of the horizontal plate in the second direction of movement of said cartons.

10. An apparatus as defined in claim 7, wherein said transfer means comprises a horizontal plate disposed between said first conveyor means and said second conveyor means for supporting the cartons received from said first conveyor means; and a transfer mechanism for moving the cartons from said horizontal plate to said second conveyor means.

11. An apparatus as defined in claim 10, wherein said transfer member further comprises at least one fluid operated cylinder having its axis of movement disposed in said second direction; and a carton engaging member connected to said cylinder to push the cartons from said horizontal plate in said second direction and into engagement with said second conveyor means.

12. An apparatus as defined in claim 10, wherein said third conveyor means comprises two spaced apart parallel endless belt conveyors disposed toward opposite longitudinal sides of said second conveyor means, said belt conveyors being inclined upwardly in said second direction from said second conveyor means, the outer surface of each of said belts being disposed in a substantially vertical plane generally parallel to said second direction, the cartons being received in the space between said belts and engaged thereby being lifted from said second conveyor means and transported to a location remote therefrom.

13. An apparatus as defined in claim 12, wherein at least one of said belt conveyors of said third conveyor means is mounted for selected movement in a direction transverse to said second direction to provide adjustment of the space therebetween for cartons of different sizes.

* * * * *

UNITED STATES PATENT OFFICE

CERTIFICATE OF CORRECTION

Patent No. 4,023,692 Dated May 17, 1977

Inventor(s) Delbert J. Ittner et al.

It is certified that error appears in the above-identified patent and that said Letters Patent are hereby corrected as shown below:

Column 6, line 19, "thereto" should read -- thereof --.

Column 9, line 23, "paarellel" should read -- parallel --.

Column 9, line 28, after "plate" insert -- downwardly --.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*